US012709806B2

(12) United States Patent
Schmitz et al.

(10) Patent No.: US 12,709,806 B2
(45) Date of Patent: Aug. 18, 2026

(54) COLD-SPRAYED TANTALUM COATINGS AND RELATED METHODS

(71) Applicant: Wisconsin Alumni Research Foundation, Madison, WI (US)

(72) Inventors: Oliver Schmitz, Madison, WI (US); Kumar Sridharan, Madison, WI (US); Mykola Ialovega, Madison, WI (US); Hwasung Yeom, Madison, WI (US); Tyler Dabney, Madison, WI (US); Danah Velez, Madison, WI (US); Marcos Navarro Gonzalez, Madison, WI (US); Evan J. Willing, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 464 days.

(21) Appl. No.: 18/211,350

(22) Filed: Jun. 19, 2023

(65) Prior Publication Data

US 2026/0015733 A1 Jan. 15, 2026

Related U.S. Application Data

(60) Provisional application No. 63/353,923, filed on Jun. 21, 2022.

(51) Int. Cl.
*C23C 24/04* (2006.01)

(52) U.S. Cl.
CPC ..... *C23C 24/04* (2013.01)

(58) Field of Classification Search
CPC ... C23C 16/4404; C23C 16/513; C23C 24/04; H01J 37/32357; H01J 37/32477–32504; H01J 2237/0268; H05H 1/26–40
See application file for complete search history.

(56) References Cited

U.S. PATENT DOCUMENTS 5,908,565 A * 6/1999 Morita ..... H01L 21/321 219/121.48
2002/0157224 A1* 10/2002 Nakagawa ..... H03H 3/08 29/25.35
2010/0015467 A1* 1/2010 Zimmermann ..... B22F 7/08 428/615
2017/0145553 A1* 5/2017 Liu ..... C25D 5/48
2019/0338418 A1* 11/2019 Goradia ..... C23C 16/45529
2021/0363645 A1* 11/2021 Ferroni ..... C23C 24/04

OTHER PUBLICATIONS

Sripada, Jagannadh VSN, et al. "Tantalum Based High-Pressure Cold Spray Coatings on Stainless Steel Substrate." *Key Engineering Materials*. vol. 813. Trans Tech Publications Ltd, 2019, pp. 429-434.

Espe, Werner, Max Knoll, and Marshall P. Wilder. "Getter materials." Electronics 23 (1950): 80.

(Continued)

*Primary Examiner* — Benjamin Kendall
(74) *Attorney, Agent, or Firm* — Bell & Manning, LLC

(57) ABSTRACT

Plasma devices are provided, which in embodiments, comprise a surface and a cold-sprayed tantalum coating adhered to the surface, the coating configured to absorb a hydrogen species from an atmosphere comprising a plasma generated in the plasma device. Methods of making the coatings and using the plasma devices are also provided.

18 Claims, 13 Drawing Sheets

(56) References Cited

OTHER PUBLICATIONS

Zubler EG. "The gettering properties of tantalum." Journal of the Electrochemical Society. Oct. 1, 1963;110(10):1072.
Velez, Danah, Mykola Ialovega, Marcos Navarro Gonzalez, Oliver Schmitz, Cary Forest, and WHAM Team. "Development of an absorbing first wall interface for small fusion devices." Poster Presentation at APS-DPP conference Nov. 8-12, 2021.
Vac Aero International, "Getter Materials" https://vacaero.com/information-resources/vac-aero-training/1166-getter-materials.html, Jun. 5, 2017.
Glass, Samuel W., Michael R. Larche, Matthew S. Prowant, Jonathan D. Suter, John P. Lareau, Xiujuan Jiang, and Kenneth A. Ross. "Cold spray NDE for porosity and other process anomalies." In *AIP Conference Proceedings*, vol. 1949, No. 1, p. 020010. AIP Publishing LLC, 2018.
Neu, et al., "Investigations on cold spray tungsten/tantalum coatings for plasma facing applications," Nuclear Materials and Energy, 2023, 6 pages, vol. 34, https://doi.org/10.1016/j.nme.2022.101343.

* cited by examiner

750 °C, 40 bar, 100% $N_2$, 200 mm/s

750 °C, 40 bar, 100% $N_2$, 400 mm/s

500 °C, 38 bar, 95% He, 400 mm/s

COLD-SPRAYED TANTALUM COATINGS AND RELATED METHODS

CROSS REFERENCE TO RELATED APPLICATIONS

The present application claims priority to U.S. provisional patent application No. 63/353,923 that was filed Jun. 21, 2022, the entire contents of which are incorporated herein by reference.

REFERENCE TO GOVERNMENT RIGHTS

This invention was made with government support under DE-AR0001258 awarded by the DOE/ARPA-E. The government has certain rights in the invention.

BACKGROUND

Absorption of hydrogen species atoms and molecules is of general importance in a variety of applications, including in vacuum as well as atmospheric and high-pressure systems. There are various approaches to achieving such absorption, including those that rely on evaporation of titanium or lithium onto steel vessels, which results in the deposition of these metals onto the steel vessels in a volatile, i.e., loosely bound form. In other approaches, refractory metals have been used in their bulk form as solid structures placed into, or incorporated as components of, devices such as vacuum pumps.

SUMMARY

The present disclosure provides cold-sprayed tantalum (Ta) coatings configured to absorb a hydrogen species from an atmosphere, e.g., a gaseous region surrounding a plasma. Devices comprising the coatings are also provided. The present disclosure also encompasses methods of forming and using the coatings.

In one aspect, plasma devices are provided. In an embodiment, a plasma device comprises a surface and a cold-sprayed tantalum coating adhered to the surface, the coating configured to absorb a hydrogen species from an atmosphere comprising a plasma generated in the plasma device.

Other principal features and advantages of the disclosure will become apparent to those skilled in the art upon review of the following drawings, the detailed description, and the appended claims.

BRIEF DESCRIPTION OF THE DRAWINGS

Illustrative embodiments of the disclosure will hereafter be described with reference to the accompanying drawings.

FIG. 2A includes the thickness values as measured using LEO software while FIG. 2B includes the thickness values as measured using the IMAGEJ/MATLAB software program.

DETAILED DESCRIPTION

Figure 1A:
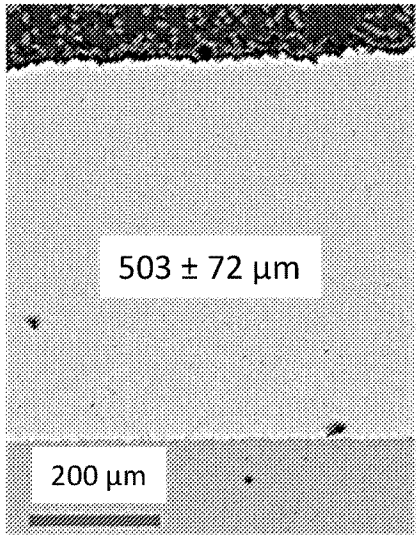
FIGS. 1A-1E show scanning electron microscope (SEM) images of cross-sections of cold-sprayed tantalum (Ta) coatings on a stainless-steel substrate obtained under five different spray conditions. The average thickness values shown in these figures were obtained using a caliper.
Figure 1B:
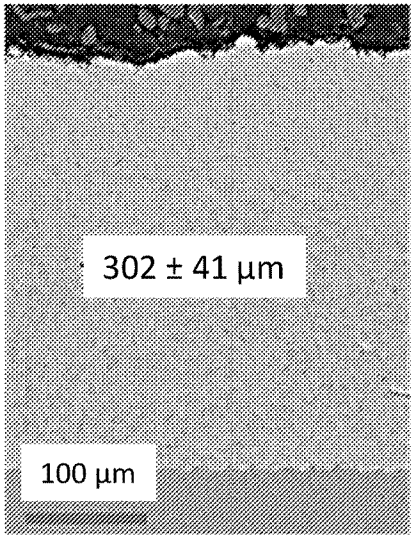
Figure 1C:
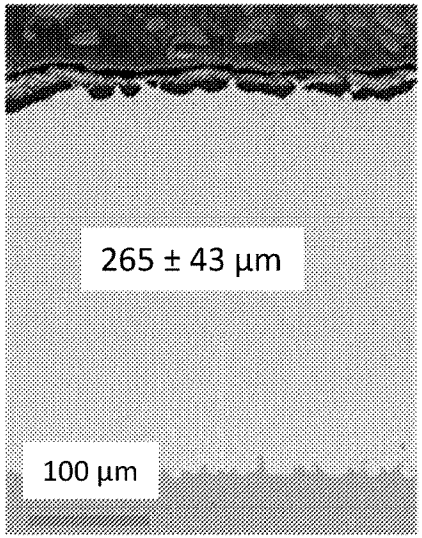
Figure 1D:
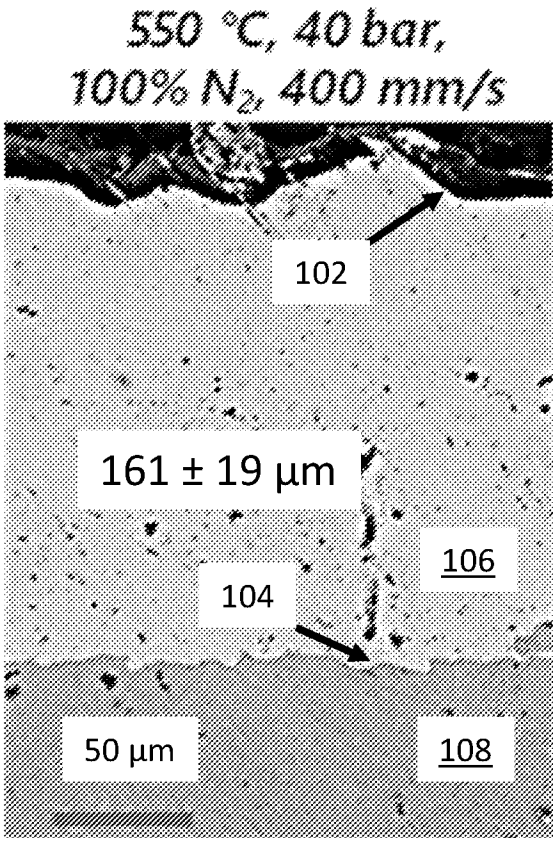
Figure 1E:
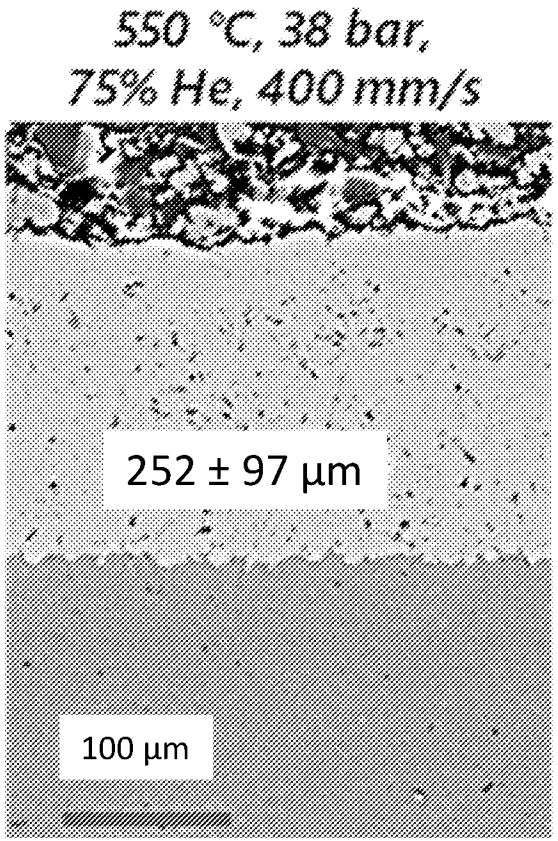

The present disclosure provides cold-sprayed tantalum (Ta) coatings configured to absorb a hydrogen species from a gaseous atmosphere in contact with the coating. This atmosphere may comprise a plasma (i.e., an ionized gas) and a gas region surrounding the plasma. The coating may be in contact (i.e., direct contact) with the gaseous region of the atmosphere, the plasma of the atmosphere, or both. The atmosphere has a pressure that is less than atmospheric pressure, and generally, significantly less than atmospheric pressure. In embodiments, the pressure of the atmosphere is less than $10^{-1}$ mbar, less than $10^{-2}$ mbar, less than $10^{-3}$ mbar, less than $10^{-4}$ mbar, less than $10^{-5}$ mbar or in a range of from $10^{-6}$ mbar to $10^{-1}$ mbar or from $10^{-5}$ mbar to $10^{-2}$ mbar. The hydrogen species in the atmosphere that is absorbed by the coating may be hydrogen (H), an isotope of hydrogen (deuterium (D), tritium (T)), or a combination thereof. The hydrogen species may be an atom, a molecule (e.g., $H_2$), or both may be present in the atmosphere and absorbed by the coating. Due to its very nature, the plasma of the atmosphere contains ions (e.g., hydrogen ions and/or hydrogen isotope ions) and at least some of these ions may generate the neutral hydrogen species that are ultimately absorbed by the coating.

The plasma of the atmosphere may be characterized by its properties (or conditions used to generate the plasma) such as pressure, temperature, ion flux, and ion energy. Illustrative pressures include those described above. Illustrative temperatures are significantly higher than room temperature and include at least 500 K, at least 1000 K, at least 1500 K, at least 2000 K, at least 2500 K, at least 3000 K, or in a range of from 500 to 3000 K. Illustrative ion fluxes include at least $10^{15}$ D/m$^2$s, at least $10^{18}$ D/m$^2$s, at least $10^{20}$ D/m$^2$s, or in a range of from $10^{15}$ D/m$^2$s to $10^{22}$ D/m$^2$s. Illustrative ion energies include at least 1 eV, at least 50 eV, at least $10^0$ eV, and from 1 eV to 1000 eV, from 10 eV to 200 eV, and from 50 eV to 1500 eV. Another relevant property is incident fluence, the total amount of ions bombarding surfaces (e.g., the cold-sprayed Ta coatings) in contact with the atmosphere. In embodiments, the incident fluence is at least $10^{20}$ D/m$^2$, at least $10^{22}$ D/m$^2$, at least $10^{25}$ D/m$^2$, or at least $10^{26}$ D/m$^2$.

The present disclosure is based, at least in part, on the unexpected discovery that cold-sprayed Ta coatings are able to absorb significant quantities of hydrogen species from an atmosphere comprising a plasma (specifically, from the low pressure, gaseous region surrounding the plasma) without being destroyed under the extreme conditions associated with the plasma, e.g., the high temperatures, high ion fluxes, high ion energies, and high incident fluences noted above. Moreover, and as further described below, it has been found that the coatings may be regenerated by desorbing hydrogen species therefrom to restore the ability of the coatings to absorb additional hydrogen species.

The present cold-sprayed Ta coatings are adhered to an underlying surface. As described in the Example below, the cold-spray process involves propelling particles towards a surface at supersonic velocities, resulting in plastic deformation of the particles and accompanying adiabatic shear. This results in the coatings being adhered to the underlying surface through strong mechanical and metallurgical bonding. The cross-sectional scanning electron microscope (SEM) images of illustrative coatings such as those shown in FIGS. 1A-1E are consistent with mechanical and metallurgical bonding between the coatings and the underlying surfaces (e.g., wavy coating/substrate interface). This type of bonding is by contrast to coating techniques such as evaporation, other vapor deposition techniques, and powder sintering which do not result in mechanical/metallurgical bonding.

The surfaces to which the present cold-sprayed Ta coatings are adhered include any type of surface in a device configured to contain the atmosphere, e.g., the plasma surrounded by the low pressure, gaseous region. Devices configured to generate and contain such an atmosphere may be referred to herein as "plasma devices." Thus, the surface to which the coatings are adhered may be composed of a variety of materials, depending upon the plasma device comprising the surface. In embodiments, the surface is a metal surface, e.g., a stainless-steel surface. Similarly, a variety of plasma devices may be used, e.g., a fusion device configured to operate with hydrogen fuel under conditions such that high-energy hydrogen ions and neutrals from the generated plasma impact the interior surfaces of the device. The present coatings may be adhered to these interior surfaces and used to absorb hydrogen species derived from the plasma.

Figure 10:
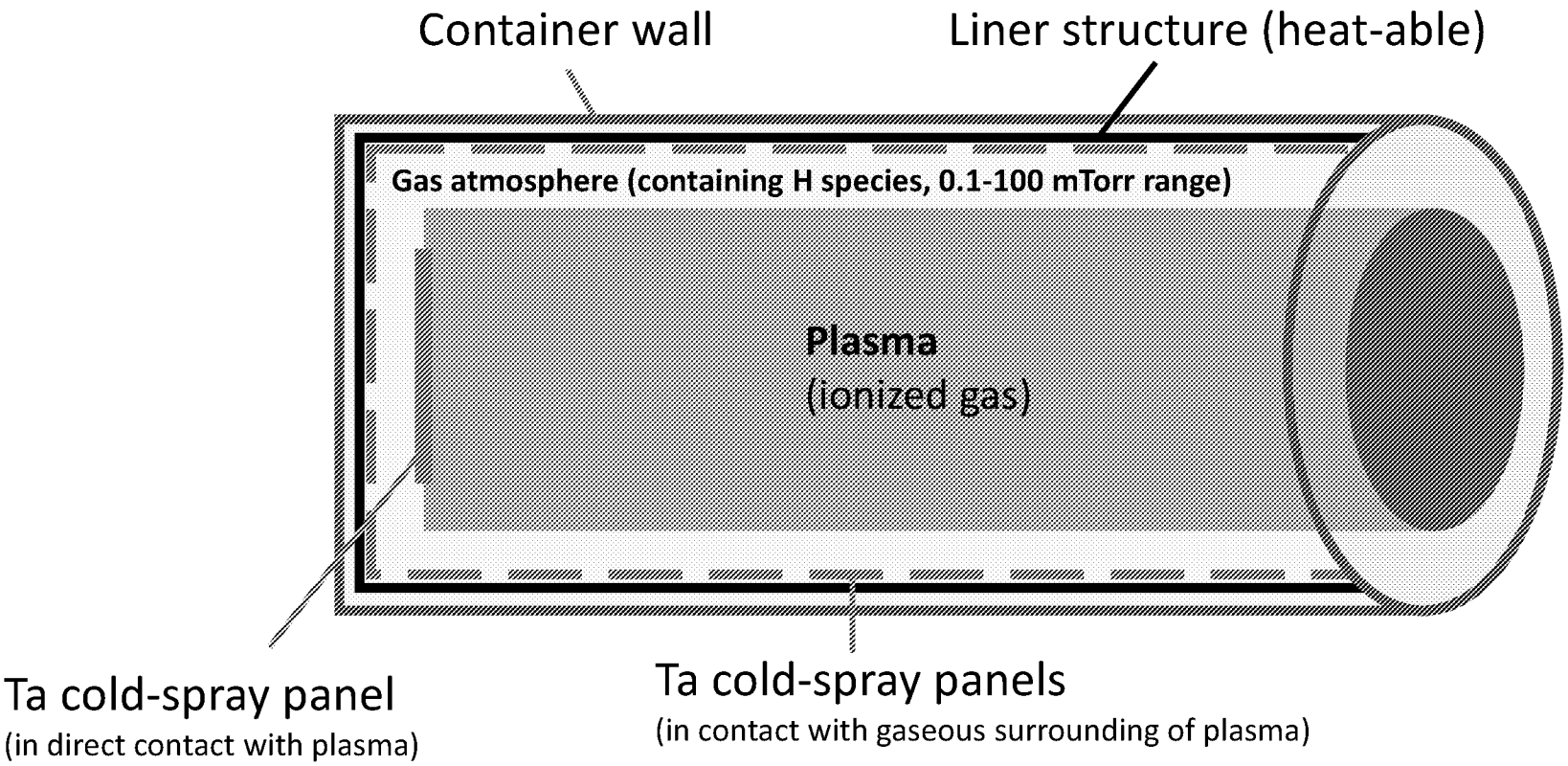
FIG. 10 depicts a schematic of a plasma device, specifically, a fusion device comprising a surface coated with a cold-sprayed Ta coating according to an illustrative embodiment.
Figure 11:
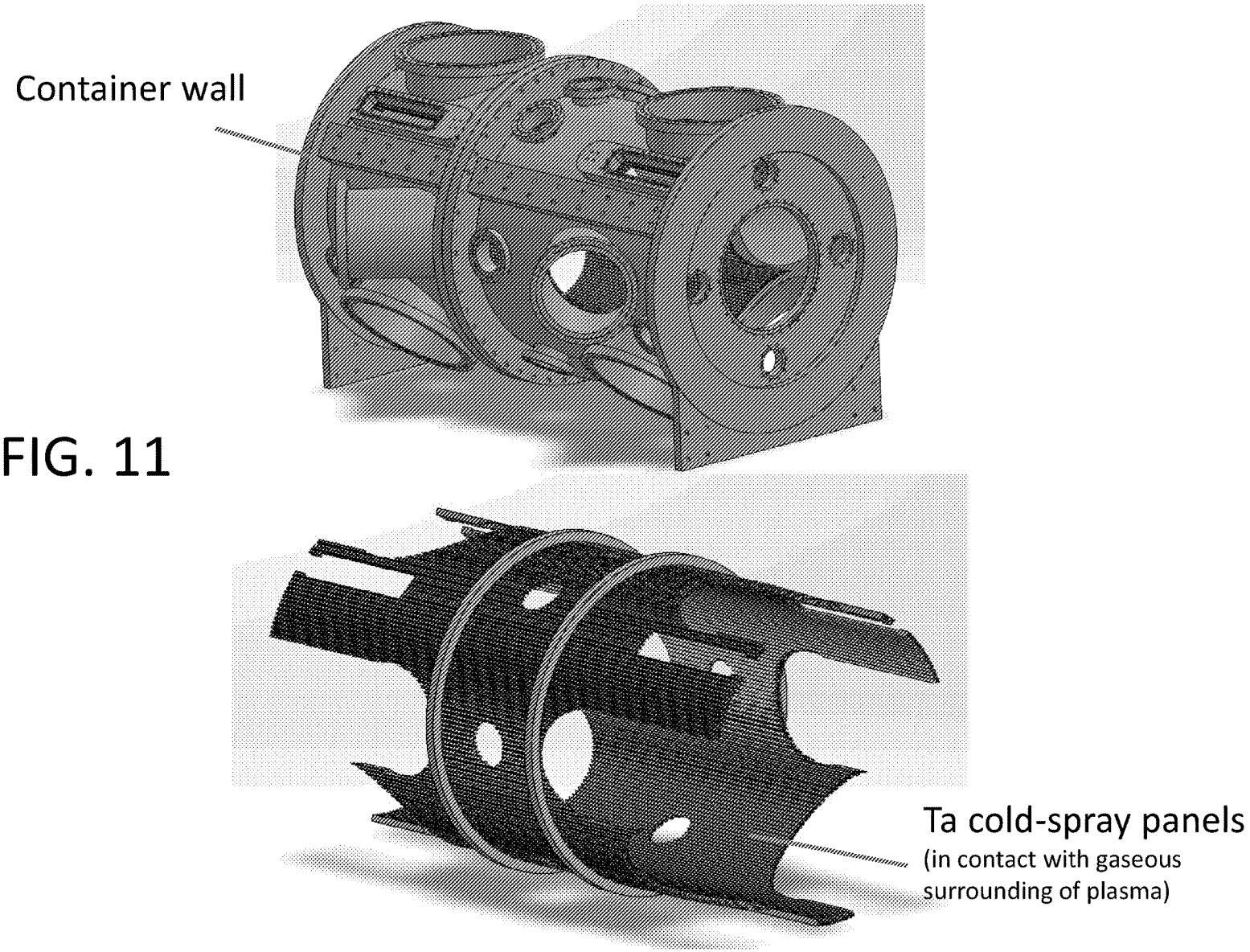
FIG. 11 shows perspective views of a container of an illustrative plasma device and an insert configured to fit inside the container, the surfaces of which have been coated with a cold-sprayed Ta coating according to an illustrative embodiment.

An illustrative fusion device is shown in FIG. 10. The fusion device comprises a container configured to generate and contain a plasma surrounded by a low pressure, gaseous region. A plurality of panels is positioned along the inner surfaces of the walls of the container. These panels may be composed of stainless steel having a surface on which any of the present cold-sprayed Ta coatings is adhered. In this embodiment, the plurality of panels is not in direct contact with the plasma, but may still be impacted by the high flux of high energy ions therein. However, the container also comprises a panel (also stainless steel having a surface on which any of the present cold-sprayed Ta coatings is adhered) that is in direct contact with the plasma as well as the low pressure, gaseous region. These coatings on the panels absorb hydrogen species from the low pressure, gaseous region, including those derived from hydrogen ions generated in the plasma. FIG. 11 shows an illustrative container of an illustrative fusion device. An illustrative stainless steel insert is also shown which may be inserted into the container. Surfaces of the stainless steel insert may have adhered thereto any of the disclosed cold-sprayed Ta coatings.

The present cold-spray Ta coatings comprise tantalum, but other elements may be present. In embodiments, the cold-spray coatings consist of tantalum. The phrase "consisting of" does not preclude the presence of small impurities and trace elements normally present in the coating due to the inherent nature of the cold-spray process. It also does not preclude the presence of an amount of absorbed hydrogen species in the coating.

The present cold-sprayed Ta coatings are characterized by a thickness. The thickness refers to the dimension of the coating as measured from an uppermost surface of the coating to the interface formed with the underlying surface, along an axis normal to the uppermost surface. The thickness may be measured from cross-sectional SEM images such as those shown in FIGS. 1A-1E and as described in the Example, below. For reference, FIG. 1D labels an uppermost surface 102 of the cold-sprayed Ta coating 106 and an interface 104 formed between the coating 106 and the underlying surface of a substrate 108. The thickness may be an average value measured from number of locations across the uppermost surface as described in the Example below. The average thickness is generally at least 150 μm and may be up to several millimeters. However, in embodiments, the average thickness is in a range of from 150 μm to 1 mm, from 150 μm to 700 μm, from 150 μm to 450 μm, from 150 μm to 375 μm, from 300 μm to 700 μm, and from 200 μm to 300 μm. These thicknesses are by contrast to coating techniques such as evaporation, other vapor deposition techniques, and powder sintering, which are limited to forming significantly relatively thinner layers of material. The other dimensions of the present coatings, i.e., lateral dimensions measured parallel to the coating and the underlying surface are not particularly limited. These generally depend upon the area of the underlying surface to be coated. However, these other dimensions may be significantly greater than the average thickness of the coating.

As noted above, the present cold-sprayed Ta coatings may be characterized by a hardness. Hardness may be measured using a standard microhardness tester with a diamond indenter tip set to 50 gf as described in the Example, below. The hardness of the coating may be at least 150 $HV_{0.050}$, at least 200 $HV_{0.050}$, at least 250 $HV_{0.050}$, at least 300 $HV_{0.050}$, or in a range of from 150 $HV_{0.050}$ to 400 $HV_{0.050}$. These hardness values are by contrast to coating techniques such as evaporation, other vapor deposition techniques, and powder sintering which result in relatively soft, mechanically weak layers of material.

Figure 4:
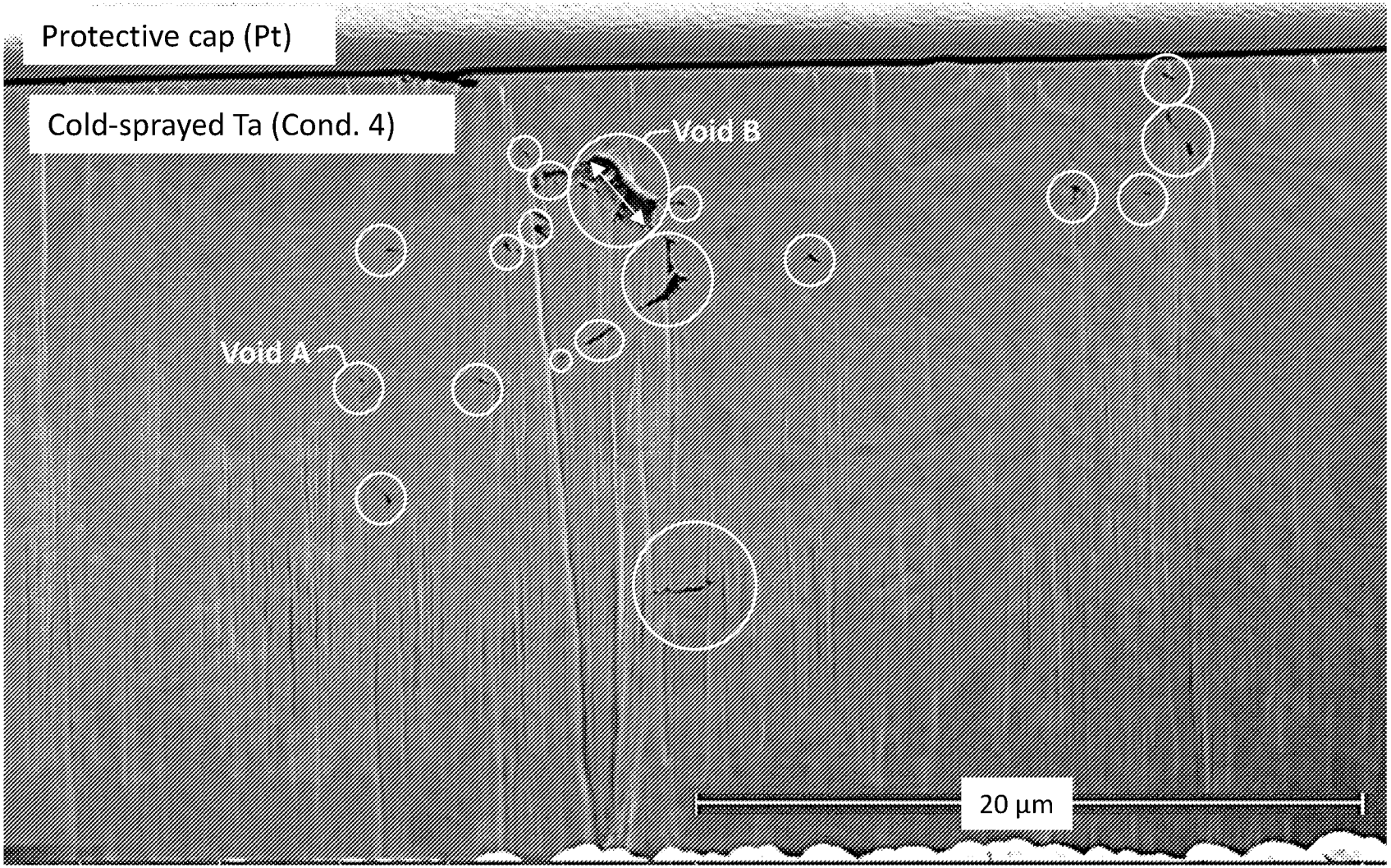
FIG. 4 shows a high-resolution/magnification cross-sectional SEM image of a cold-sprayed Ta coating obtained using spray condition #4 (see FIG. 1D). Micro-voids formed in the coating are indicated with white circles; two are labeled as void A and void B.

The present cold-spray Ta coatings may be characterized by their morphology. The solid matrix of the coating is formed by deformed Ta particles which become adhered to one another during the cold-spray process. However, interparticle voids are distributed throughout this solid matrix, i.e., empty spaces defined by surfaces of neighboring particles. For example, FIG. 4 shows a cross-sectional SEM image of an illustrative coating in which several of micro-voids are marked with circles. These micro-voids are atypical for a cold-spray coating since, as further described in the Example below, cold-spray is a process intended to form dense, non-porous coatings. In the present coatings, these micro-voids contribute to an overall porosity value for the coating.

Inter-particle voids may assume various shapes and dimensions. For example, as shown in FIG. 4, some voids (see void A) are spherical in shape. Other voids (see void B) are irregularly shaped. A void may be characterized by a largest dimension as measured across opposing surfaces of the void from cross-sectional SEM images such as that of FIG. 4 (see the double-sided arrow in void B). Transmission electron microscopy (TEM) may also be used to measured void dimensions, particularly those of relatively small sized voids. The coatings may include voids having their largest dimension on the order of nanometers, e.g., 10 nm, 100 nm, 250 nm, 500 nm, or in a range of from 10 nm to 500 nm. These voids may be referred to as nano-voids. The coating may include voids having their largest dimension on the order of microns, e.g., 1 μm, 3 μm, 5 μm, or in a range of from 1 μm to 5 μm. These voids may be referred to as micro-voids. Both types of voids may be present. In embodiments, the coating may be characterized as having a plurality of voids, the voids having a largest dimension of at least 500 nm, at least 750 nm, at least 1 μm, or at least 3 μm.

Also contributing to the overall porosity of the present cold-sprayed Ta coatings are grain boundaries which define even smaller empty spaces within the solid matrix of the coating. These spaces also allow for the ingress/egress of hydrogen species, contributing to the ability of the coatings to absorb significant quantities of hydrogen species.

As noted above, the present cold-sprayed Ta coatings may be characterized by an overall porosity. The porosity may be measured by using image analysis of an electron beam-based micrograph of a cross-section of a cold-sprayed Ta coating. In embodiments, the porosity is in a range of from 0.08% to 2%, from 0.1% to 2%, from 0.2% to 1.5%, or from 0.5% to 2%.

The present cold-sprayed Ta coatings may be characterized by their hydrogen species absorption capacity. This may be measured by using thermo-desorption to quantify hydrogen species absorption capacity for the coating under certain conditions, e.g., plasma conditions, as described in the Example below. Gas charging experiments and thermo-desorption may also be used to measure hydrogen species absorption capacity as described in the Example, below. The hydrogen species absorption capacity may refer to all hydrogen species being absorbed or a particular hydrogen species, e.g., deuterium. The hydrogen species absorption capacity may be at least $10^{19}$ (hydrogen species)/cm$^2$, at least $10^{20}$ (hydrogen species)/cm$^2$, at least $10^{21}$ (hydrogen species)/cm$^2$, at least $10^{22}$ (hydrogen species)/cm$^2$, or in a range of from $10^{19}$ (hydrogen species)/cm$^2$ to $10^{23}$ (hydrogen species)/cm$^2$. The hydrogen species absorption capacity may refer to a particular set of plasma conditions, e.g., pressure, temperature, ion flux, ion energy, incident fluence, as well as exposure time. Illustrative values of pressure, temperature, ion flux, and ion energy include any of those described herein. Illustrative exposure times include from seconds to a few hours (e.g., two to three) to several hours. The hydrogen species absorption capacity may refer to an initial value for the coating obtained after an initial exposure to the plasma and before any desorption of hydrogen species and subsequent re-exposure to the plasma.

As noted above, it has been found that the present cold-sprayed Ta coatings may be regenerated, including after plasma exposure, by desorbing the hydrogen species therefrom. This may be accomplished by heating the coating to a temperature for a period of time. The temperature and time are selected to drive off the hydrogen species, including to maximize desorption. Illustrative temperatures include those from 523 K to 1000 K. Illustrative times include those from 10 minutes to couple of hours. The desorption process is generally carried out under low pressures, including any of the pressures described above.

The coatings may be characterized by a recycling coefficient defined and measured as described in the Example below. The recycling coefficient may be no more than 1 or in a range of from 0 to 1. The recycling coefficient may refer to a value for the coating obtained after a certain number of cycles of plasma exposure followed by desorption, e.g., 1, 5, 10, 50, 100, etc. The recycling coefficient may refer to particular set of plasma conditions as well as a particular set of desorption conditions, both of which may include any of those described herein.

As noted above, it is unexpected that the present cold-sprayed Ta coatings are able to exhibit high hydrogen species absorption capacities without being damaged or destroyed under the extreme conditions associated with plasmas, particularly in view of their porous nature and the voids distributed throughout. The ability of the coatings to withstand plasma conditions is demonstrated by the coatings exhibiting no change in their structure and properties after exposure to the plasma. For example, the coatings may be characterized by one or more of the following: having an average thickness after plasma exposure that is within ±10% of the average thickness as measured prior to any plasma exposure; having a hardness after plasma exposure that is within ±10% of the hardness as measured prior to any plasma exposure; having voids, each void characterized by a largest dimension after plasma exposure that is within ±10% of the largest dimension as measured prior to any plasma exposure; having a porosity after plasma exposure that is within ±10% of the porosity as measured prior to any plasma exposure. In each of these cases, the phrase "after plasma exposure" may refer to a particular set of plasma conditions (of which any of those disclosed herein may be used) and a single plasma exposure or a particular number of cycles of plasma exposure followed by desorption (of which any of those disclosed herein may be used).

Similarly, the present cold-sprayed Ta coatings may be characterized by a hydrogen species absorption capacity as measured after one or more cycles (e.g., 1, 5, 10, 50, 100, etc.) of plasma exposure followed by desorption that is within ±10% of the initial value of hydrogen species absorption capacity. The recycling coefficient values measured after one or more cycles of plasma exposure followed by desorption as set forth above also reflect the robustness of the coatings to the extreme conditions associated with plasmas.

Methods of forming the present cold-sprayed Ta coatings are also encompassed. Such methods comprise exposing any of the surfaces disclosed herein to a source of Ta particles from a cold-spray system under conditions to form any of the cold-sprayed Ta coatings described herein adhered to the surface. The source of Ta particles in the cold-spray system is a gas jet comprising a gas (or a mixture of gases) and the Ta particles. An illustrative cold-spray system which may be used in shown in FIG. 9. The conditions under which the surface is exposed to the gas jet conditions refer to parameters such as gas composition, physical characteristics of the Ta particles, gas preheat temperature, gas pressure, and translation speed of the gas jet across the surface to be coated. Values of these parameters may be adjusted in order to achieve any of the coatings disclosed herein. As noted above and further described in the Example, below, at least some parameters used to achieve the present coatings are contrary to those used in existing cold-spray processes which are intended to form dense, non-porous coatings. Illustrative values of parameters used to achieve the present coatings are provided in the Example, below. However, in embodiments, the gas comprises $N_2$ and the Ta particles and is free of He. In embodiments, the gas consists of $N_2$ and the Ta particles. In embodiments, the gas pressure is less than 40 bar, less than 38 bar, less than 35 bar, or in a range of from 10 bar to 40 bar. In embodiments, the gas preheat temperature is less than 600° C., less than 550° C., less than 500° C. or in a range of from 100° C. to 750° C.

Methods of using the present cold-sprayed Ta coatings are also encompassed. Such methods comprise exposing any of the disclosed coatings to any of the disclosed atmospheres, e.g., a plasma, comprising the hydrogen species. The exposure may be carried out by operating a plasma device to generate the plasma, the plasma device comprising the coatings adhered to surfaces of the plasma device.

EXAMPLE

Introduction

This Example demonstrates a new type of a tantalum (Ta) functional wall interface formed by cold-spraying Ta onto a substrate surface. Suitable substrate surfaces include those found in vacuum devices requiring a low residual pressure of hydrogen species (e.g., hydrogen and its isotopes, in atomic or molecular form). The interface is capable of retaining significant amounts of the hydrogen species and can be regenerated in situ by outgassing at certain temperature and pressure ranges for long-term continued use. At the same time, the interface is unexpectedly resistant to high temperatures, thermal shock from high heat flux, and energetic particle bombardment. Thus, the interfaces may be used in a variety of plasma devices.

Materials and Methods

Figure 9:
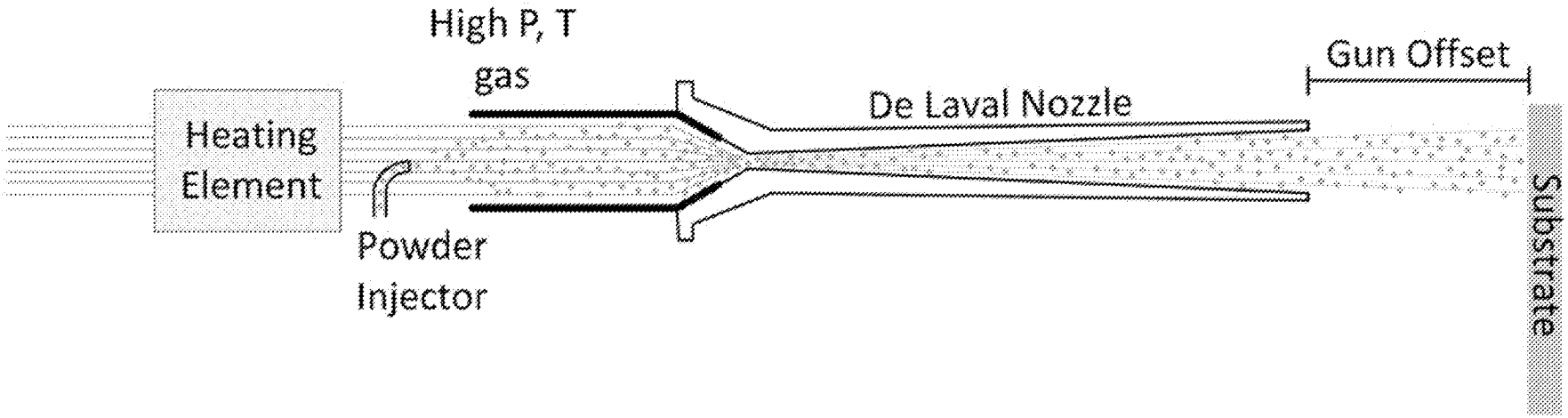
FIG. 9 depicts a schematic of an apparatus that may be used to form the present cold-sprayed Ta coatings.

A cold-spray process was used to deposit tantalum coatings using commercially procured Ta powders as precursor. A schematic of the apparatus used to carry out the cold-spray process is shown in FIG. 9. In the cold-spray process, the feedstock powder material is propelled at supersonic velocities onto the surface of a substrate, which upon impact forms a well adhered coating due to plastic deformation of the particles. As shown in FIG. 9, propulsion of the powder particles is attained by feeding them through a preheated, pressurized gas ($N_2$, He, or a mixture), where the particles are accelerated through a specially engineered converging-diverging de Laval nozzle. The temperature of the particles remains low, and particle deposition occurs in solid state which prevents phase transformations, oxidation, and microstructural changes of the feedstock powder during deposition. Coating formation (both coating-substrate adhesion and inter-particle bonding) occurs by plastic deformation and an associated adiabatic shear process. The cold spray process is conducted at room temperature and atmospheric pressure, and high particle velocities coupled with a ductile feedstock material result in significantly higher deposition rates, allowing relatively thick coatings to be achieved.

In this Example, spherical, pure Ta powder (particles having an average diameter of less than 10 μm) was used. Before spraying, stainless steel SS316 substrates were lightly ground with 320 grit SiC abrasive paper and cleaned with ethanol to remove any native oxide from the surface and to slightly roughen the surface to improve adhesion. The substrates' thickness was measured with a caliper before and after deposition to get an estimate of the coating thickness. Five spray runs were performed, with parameters shown in Table 1, below. Each spray run lasted a total duration of only one minute or less. Thus, the present methods can quickly and efficiently achieve cold-spray Ta coatings, even over relatively large areas.

TABLE 1

Cold-spray deposition conditions.

| Spray Condition | Gas Composition | Gas Temperature (° C.) | Gas Pressure (bar) | Gun Translation Speed (mm/s) |
|---|---|---|---|---|
| 1 | 100% $N_2$ | 750 | 40 | 200 |
| 2 | 100% $N_2$ | 750 | 40 | 400 |
| 3 | 95% He/5% $N_2$ | 500 | 38 | 400 |
| 4 | 100% $N_2$ | 550 | 40 | 400 |
| 5 | 75% He/25% $N_2$ | 550 | 38 | 400 |

Properties of the resultant Ta coatings reflect a complex relationship between the feedstock powder (particle characteristics), the underlying substrate, and the cold spray parameters. Generally, the gas temperature, pressure, and powder particle size dictate the particle velocity. Increasing the velocity by increasing the gas temperature and pressure, or by increasing the amount of He in the gas mixture, typically results in more severe plastic deformation of the powder particles upon impact leading to hard, dense, non-porous coatings. In fact, existing cold-spray processes are usually carried out with an intended purpose of maximizing density and minimizing porosity of the resulting coating. By contrast to this accepted approach, in this Example, parameters are used to achieve less dense, more porous coatings. This may be accomplished by using lower gas temperatures and pressures and forgoing He in the gas mixture. Calculated particle velocities are as follows: about 650 m/s (pure $N_2$), about 900 m/s (75% He/25% $N_2$), and about 1150 m/s (95% He/5% $N_2$). The gun translation speed can be used to vary the coating thickness, with slower speeds allowing for higher dwell time and hence higher thickness.

The following describes the various techniques and tests that were carried out to characterize the cold-sprayed Ta coatings.

For some characterizations, metallographic sample preparation for the cold-sprayed Ta coatings, including sectioning, mounting, and polishing, was carried out to facilitate accurate characterization of the samples. In addition, surface finishing can be used to decrease the surface roughness and to control the coating thickness of the as-deposited cold-sprayed Ta coatings.

Figure 2A:
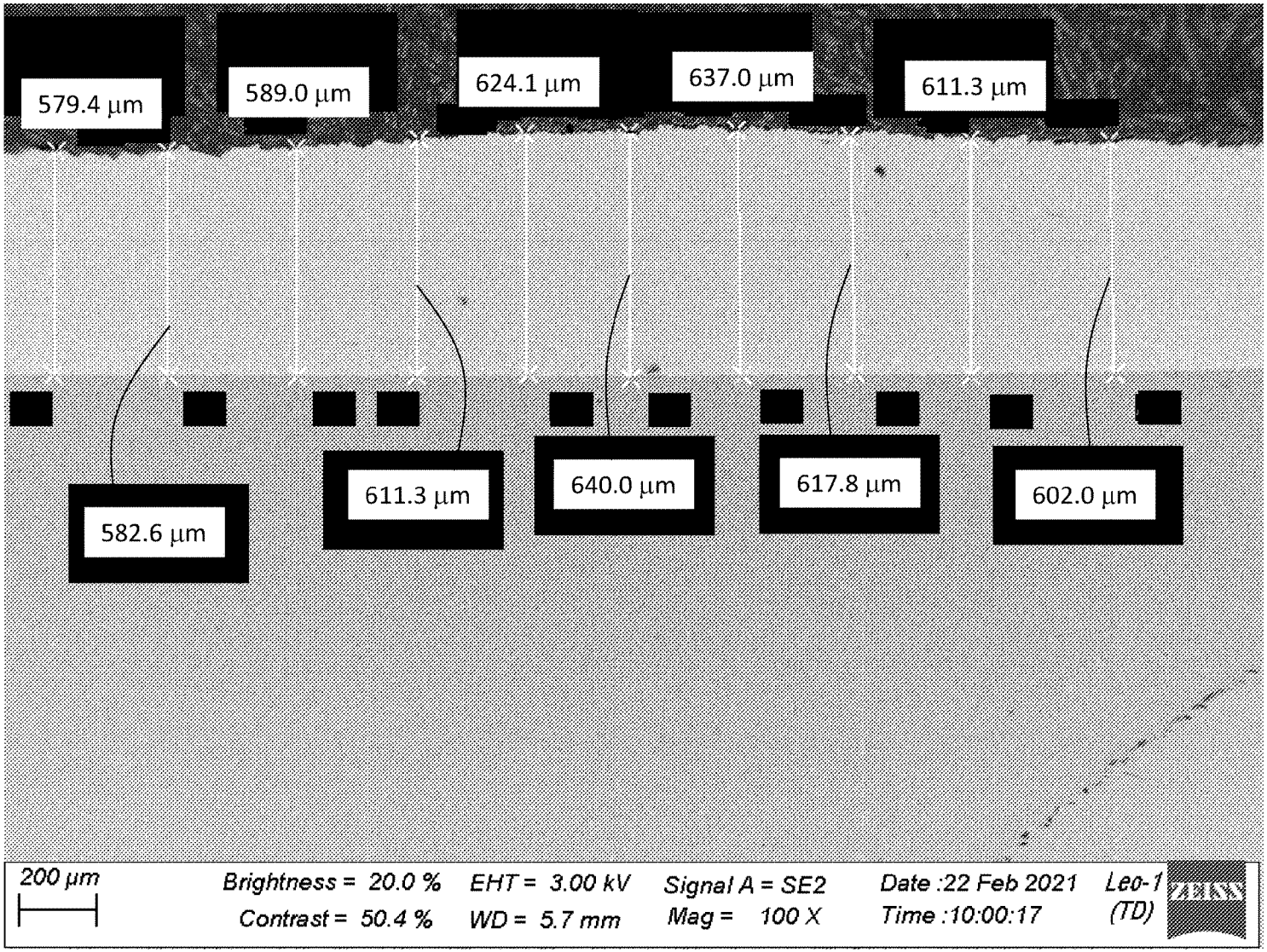
FIGS. 2A and 2B show SEM images of a cross-section of a cold-sprayed Ta coating on a stainless-steel substrate. Thickness values were measured as described in the Example, below.
Figure 2B:
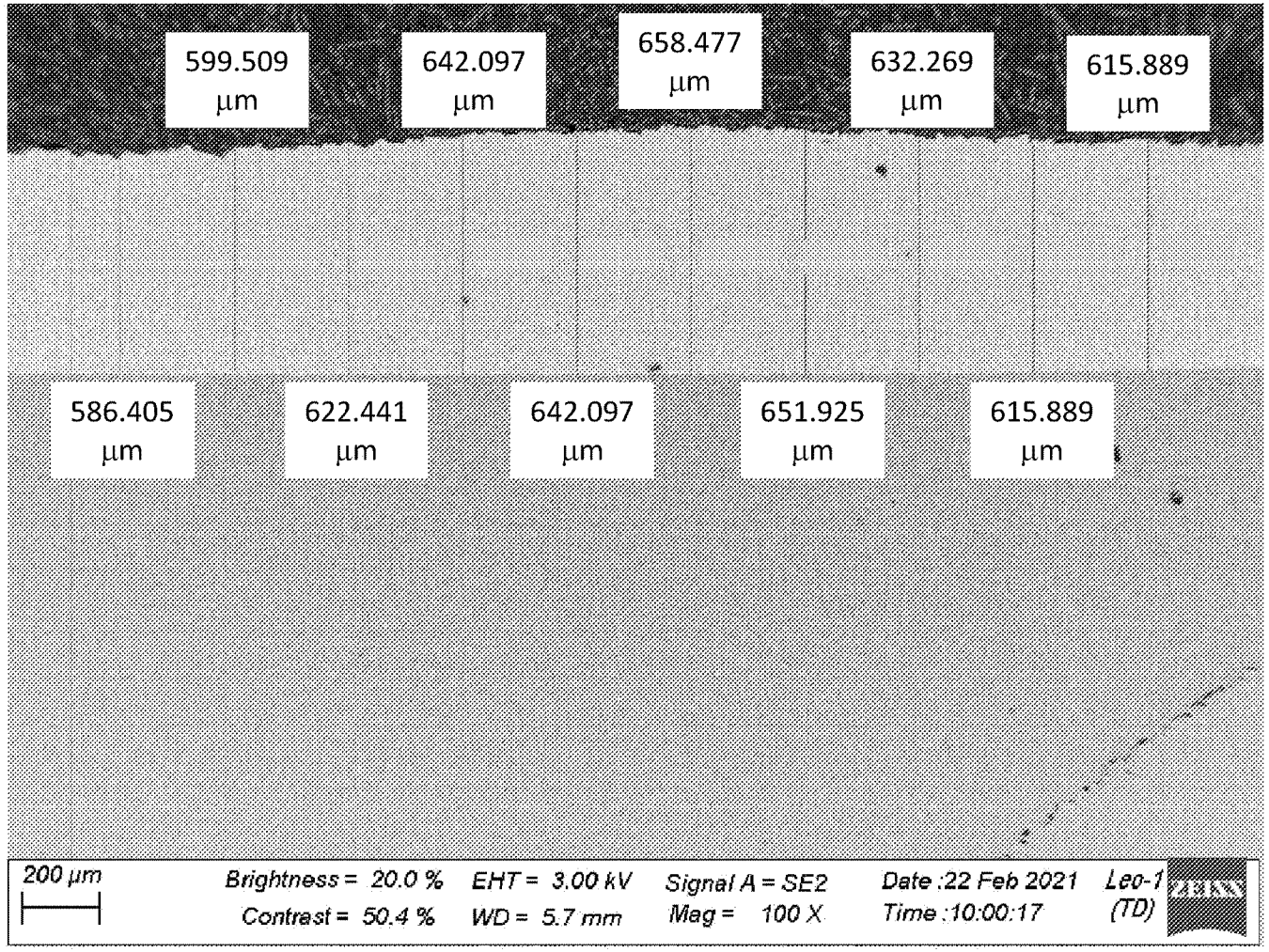
Figure 3A:
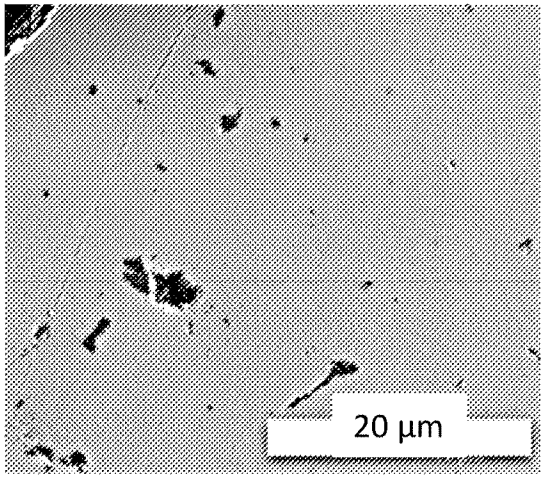
FIGS. 3A-3E show SEM images of surfaces of the cold-sprayed Ta coatings of FIGS. 1A-1E obtained under five different spray conditions.
Figure 3B:
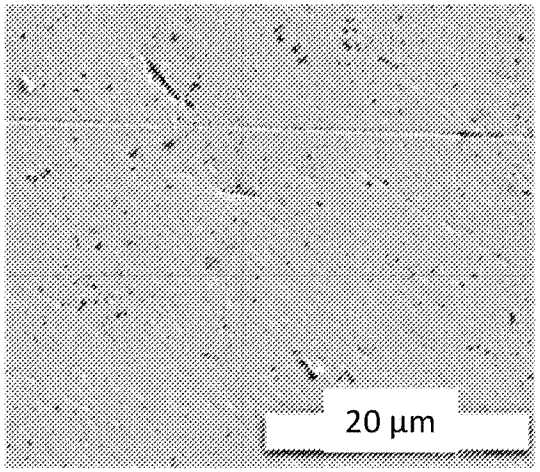
Figure 3C:
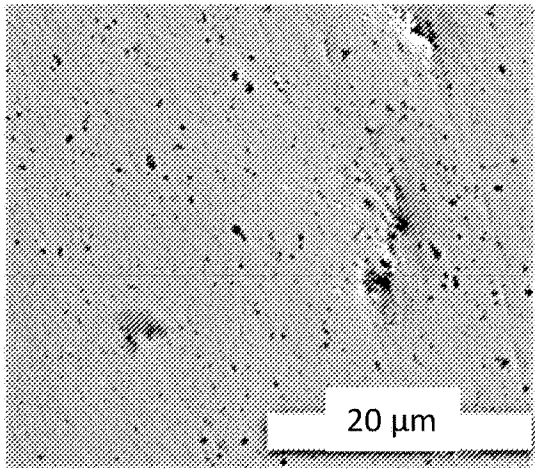
Figure 3D:
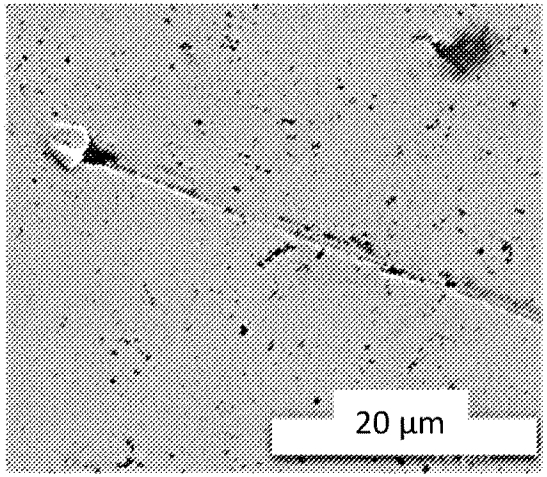
Figure 3E:
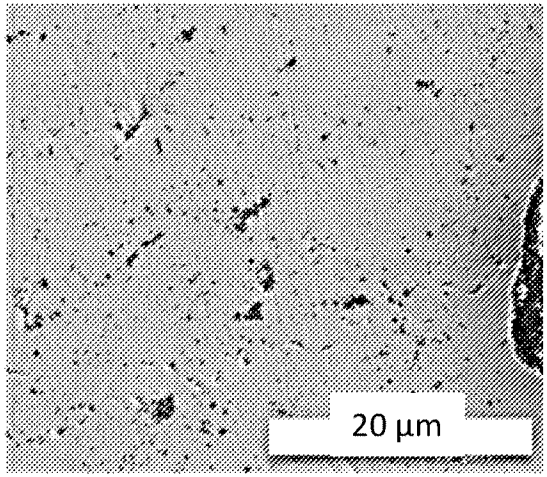

Surface morphology was examined at the micrometer scale using scanning electron microscopy (SEM). Cross-sectional SEM imaging was also used to measure the thickness of the coatings. Such thickness measurements were performed on as-deposited cold-sprayed Ta coatings with no preparation of the coating surface (i.e., no surface finishing, no metallographic sample preparation). Coating thickness was measured using no less than 4 and no more than 7 SEM images of the cross-sectioned coating. Each image used for a thickness measurement was acquired at a unique location in the coating, with lateral distance of no less than 1 mm separating the images. Within each image, 10 measurements were taken normal to the interface from the surface of the coating to the coating/substrate interface. Individual measurements were spaced no less than 100 micrometers apart. All thickness measurements taken within one coating were averaged to produce one value for coating thickness and a standard deviation. (See FIGS. 2A-2B.)

X-ray diffraction (XRD) analysis was used to ensure phase identification and phase purity, and for residual stress measurements. X-ray photoelectron spectroscopy (XPS) was used to identify composition and chemical state of elements in the near-surface regions of the samples (within several nm below the surface).

A microhardness test was performed to examine hardness (ability to withstand localized permanent deformation) of the coatings.

Focused ion beam (FIB) and SEM were used to create cross-sections of the coatings to examine the microstructural morphology of the coatings on a micrometer scale.

A low kinetic energy ($E_{kin\ max}$=95 eV) high-fluence deuterium ion (D, a hydrogen isotope) implantation experiment was performed in a linear plasma device PSI-2 (Germany) at 3 different substrate temperatures: 523 K, 773 K, and 1000 K. Thus, in these experiments, the cold-sprayed Ta coatings were subjected to plasma conditions including high temperatures and high fluxes of deuterium ions. The deuterium ion flux was about $3\times10^{25}$ D/m$^2$. The pressure in the plasma device was about $10^{-6}$ mbar. Post-exposure analysis (i.e., after deuterium plasma exposure) included SEM, XRD and XPS analysis to evaluate the effects of the plasma experiment on surface morphology (SEM), structure (XRD), and composition (XRD) of the cold-sprayed Ta coatings at different substrate temperatures.

Thermo-desorption measurements will be conducted to evaluate the D content in the plasma exposed samples (i.e., the cold-sprayed Ta coatings subjected to deuterium plasma). This will provide a direct measurement of the D incorporated therein. These measurements will be carried out as follows: Plasma exposed samples are introduced in ultra-high vacuum device (base pressure $10^{-9}$ mbar) where they are heated with a constant temperature ramp of 1 K/s up to 1300 K. A mass spectrometer is used to detect outgassing molecular species containing deuterium, including HD, $D_2$, HDO and $D_2O$. The total amount of outgassed D is obtained by integrating the desorption spectra and applying appropriate sensitivity coefficients for each of the species.

Gas charging experiments will be conducted to evaluate gas absorption and release from the cold-sprayed Ta coatings at different temperature and vacuum conditions. These experiments will be carried out as follows: Cold-sprayed Ta coating samples are introduced in a vacuum device (base pressure $10^{-7}$ mbar) and outgassed for 2 h at 773 K. Then, samples are cooled down to room temperature (293 K), or 523 K, or 773 K and D gas at a partial pressure of $10^{-6}$ mbar is introduced in the device. The samples are kept in D atmosphere at the chosen temperature for 3 h. After that, samples are cooled down to RT and a thermo-desorption measurement is performed as described above. Gas charging allows adsorption of molecular $D_2$ by the samples, permeation of D into the samples, and population of all traps in the material. This combination of gas charging and thermo-desorption measurements allows determination of a hydrogen species absorption capacity for the coatings.

The deuterium plasma experiments described above also allow for a well-controlled quantification of the incident flux of the deuterium species. Thermo-desorption experiments performed on the plasma exposed Ta coatings will determine the amount of trapped deuterium as described above. The amount of reflected and implanted deuterium can be estimated using modeling tools (such as TRIM code). Thus, the recycling coefficient Rc can be determined: Rc=((implanted D atoms)−(desorbed D atoms during thermo-desorption))/(implanted D atoms). This value indicates how much of D is retained in the Ta coatings.

Results

FIGS. 1A-1E are SEM images of cross-sections of cold-sprayed Ta coatings obtained under the five different spray conditions described in Table 1 (the spray conditions are also shown for each image). In each image, the bottom-most layer (darker gray) is the stainless-steel substrate and the next layer up (lighter gray) is the cold-sprayed Ta coating. The SEM images show excellent adhesion to the underlying substrate surface without cracking or spallation at the Ta coating-stainless-steel interface.

As shown in FIGS. 1A-1E and FIGS. 2A-2B, the average thickness values of the cold-sprayed Ta coatings were several hundred microns. This is by contrast to coatings formed using vapor phase evaporation techniques which are limited to average thicknesses in a range of from about 1 μm to 30 μm.

Hardness of the cold-sprayed Ta coatings was measured using a standard microhardness tester with a diamond indenter tip, set to 50 gf. A minimum of 10 indents were taken across the cross-section of the coating with sufficient distance maintained from the coating-substrate interface and other indents to reduce edge effects and effects from neighboring indents. The hardness of the coating obtained under spray condition #1 (see Table 1) was 298.0±17.2 $HV_{0.050}$. The hardness of the coating obtained under spray condition #2 (see Table 1) was 301.1±19.8 $HV_{0.050}$. Hardness of the Ta powder increases during deposition due to plastic deformation and associated work hardening upon particle impact. The cold-sprayed Ta coatings are harder than annealed bulk tantalum (<100 HV) (See Huang et al., IOP Conference Series: Materials Science and Engineering 63, 2014). The hardness of the cold-sprayed Ta coatings is significantly greater than is possible using other coating techniques (e.g., vapor phase evaporation techniques or powder sintering).

As noted above, SEM was also used to examine the surface morphology of the cold-sprayed Ta coatings. FIGS. 3A-3E show SEM images of surfaces of the cold-sprayed Ta coatings obtained under the five different spray conditions described in Table 1.

The morphology of the interior of the cold-sprayed Ta coatings was examined using high-resolution/magnification cross-sectional SEM images. FIG. 4 shows such an image of the coating formed using spray condition #4. The image shows numerous micro-voids (several of which are outlined with circles) within the solid matrix of the coating. Higher magnification, higher resolution images also reveal numerous nano-voids, grain boundaries, and fine grains structure which are believed to act as sinks for absorption of hydrogen species. Together, the micro-voids, nano-voids, and the grain boundaries contribute to the porosity of the coating, which promotes diffusion and permeation of hydrogen species as well as increases retention of such species in the coatings. The most porous coatings are formed using spray conditions 1, 2 and 4 (these used $N_2$ only as the carrying gas). Virtually no micro-voids were found in the coatings formed using spray conditions 3 and 5 (these included He in the carrier gas mixture).

Figure 5:
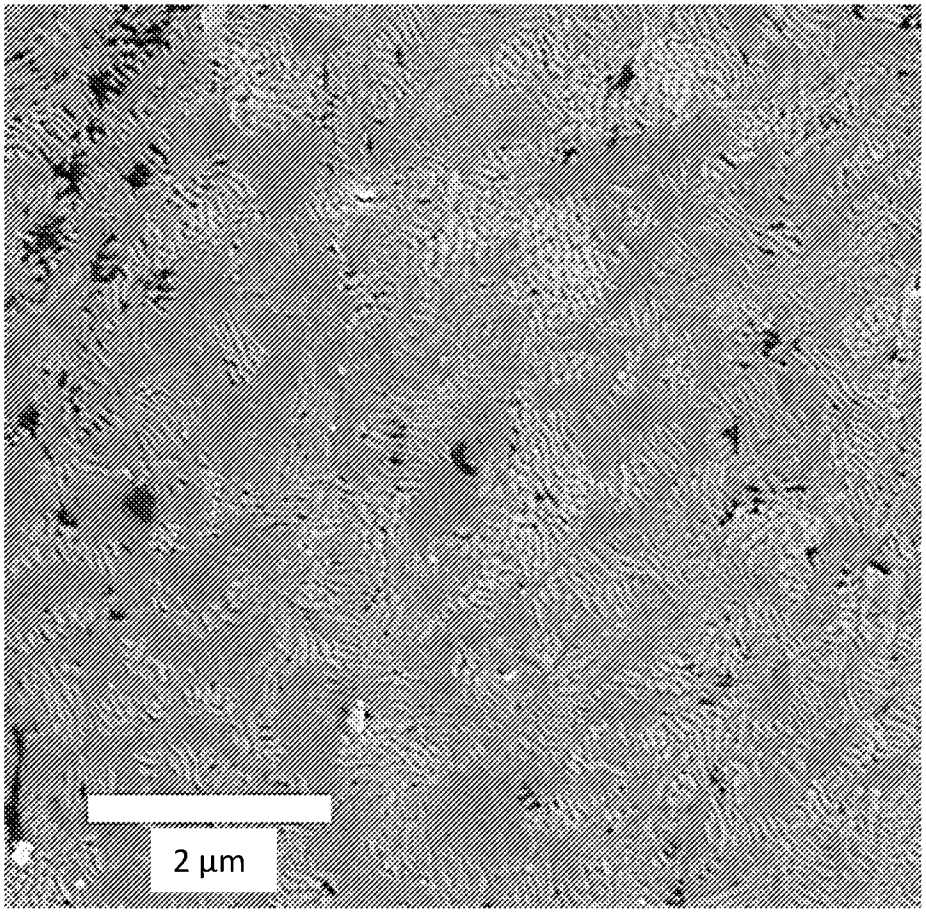
FIG. 5 shows an SEM image of a surface of a cold-sprayed Ta coating after high temperature (1000 K) deuterium plasma exposure.

FIG. 5 is an SEM image of a cold-sprayed Ta coating after the deuterium plasma exposure using 95 eV D ions at substrate temperature of 1000 K. The image shows some nanostructure formation on the surface due to the temperature effect, but otherwise no changes in surface morphology were observed. Similarly, other cross-sectional SEM images revealed no delamination or structural changes in any of the cold-sprayed Ta coatings after the plasma exposure, even up to 1000 K. It is unexpected that the cold-spray Ta coatings were able to sustain the extreme conditions of the plasma exposure, i.e., the high temperatures and high flux of energetic particles, without any significant changes to its morphology.

Figure 6:
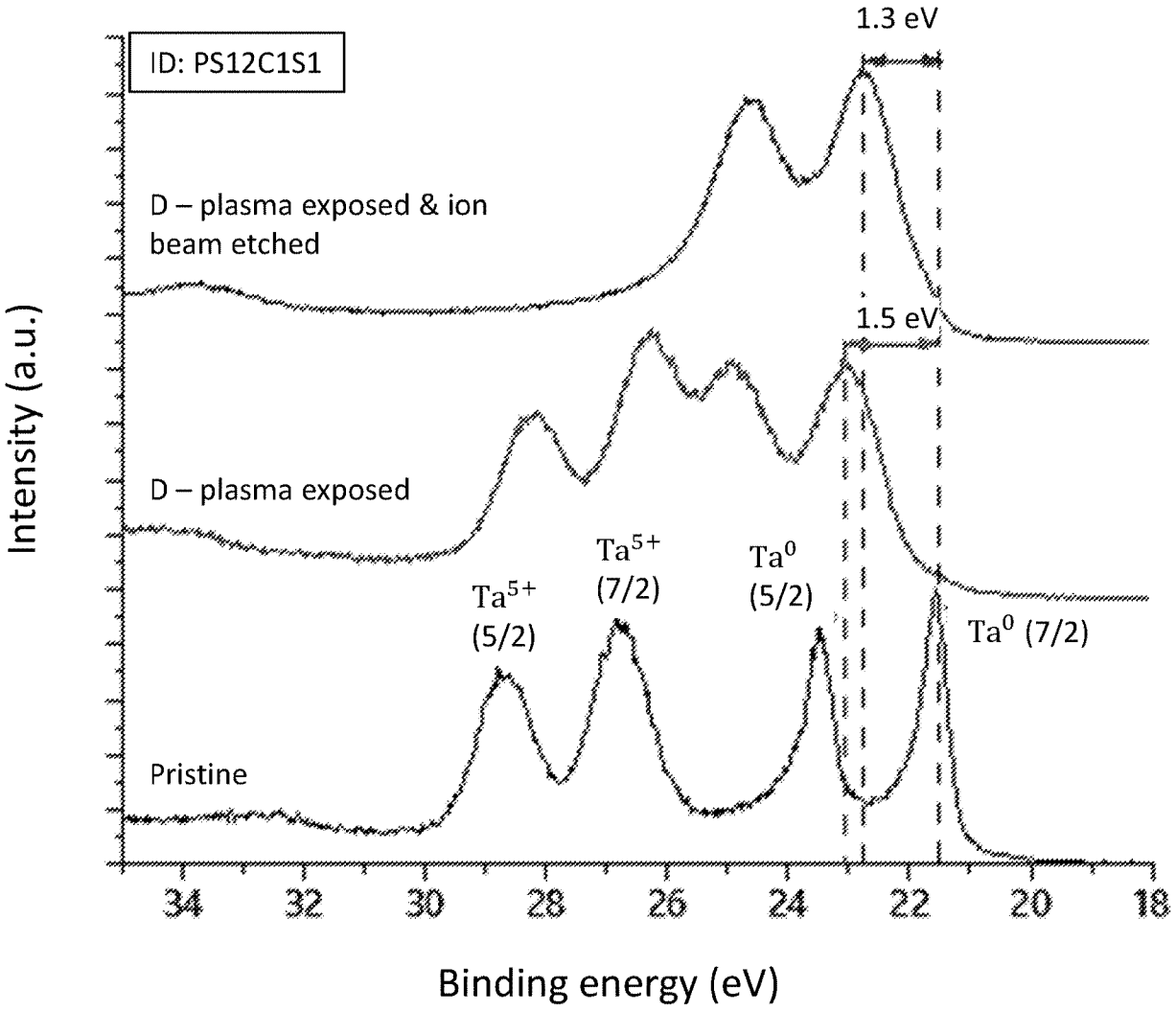
FIG. 6 shows X-ray photoelectron spectroscopy (XPS) spectra of a cold-sprayed Ta coating before, after deuterium plasma exposure at 523 K and after etching the plasma exposed coating by 2 keV Art.

Two measurements were carried out demonstrating D incorporation in the Ta lattice of the cold-sprayed Ta coatings during the plasma exposure. The first set of measurements was performed in an XPS apparatus. The samples were irradiated with X-rays and the emitted photoelectrons were collected. This technique probes the characteristic binding energy several nm under the surface of the coating. For example, FIG. 6 shows the pristine (non-plasma exposed) cold-sprayed Ta coating (spray condition #1) (bottom spectrum). This spectrum shows the presence of metallic tantalum (the doublet peaks structure $Ta^0$ 7/2 and $Ta^0$ 5/2 at 21.6 eV and 23.5 eV, respectively) and tantalum oxide $Ta_2O_5$ (the doublet peaks structure of oxidation states $Ta^{5+}$ 7/2 and $Ta^{5+}$ 5/2) in the subsurface layer. The middle spectrum shows the cold-sprayed Ta coating after plasma exposure at 523 K and a clear shift of the metallic Ta peaks by 1.5 eV. This signifies a change in the electron binding energy of Ta due to a change in the surrounding lattice (and thus, a change to the chemical state of Ta). This may be due to either D incorporation or the presence of additional oxidation states. In order to clarify the origin of the peak shift, the sample was etched by 2 keV Ar ions to penetrate deeper under the surface so as to remove the oxide contribution from the sample. The corresponding spectrum is the top spectrum in FIG. 6. The fact that Ta peak position remained shifted even after the oxide contribution is removed indicative of deep D incorporation within the Ta coating, beyond the thickness of an overlying oxide layer.

Figure 7:
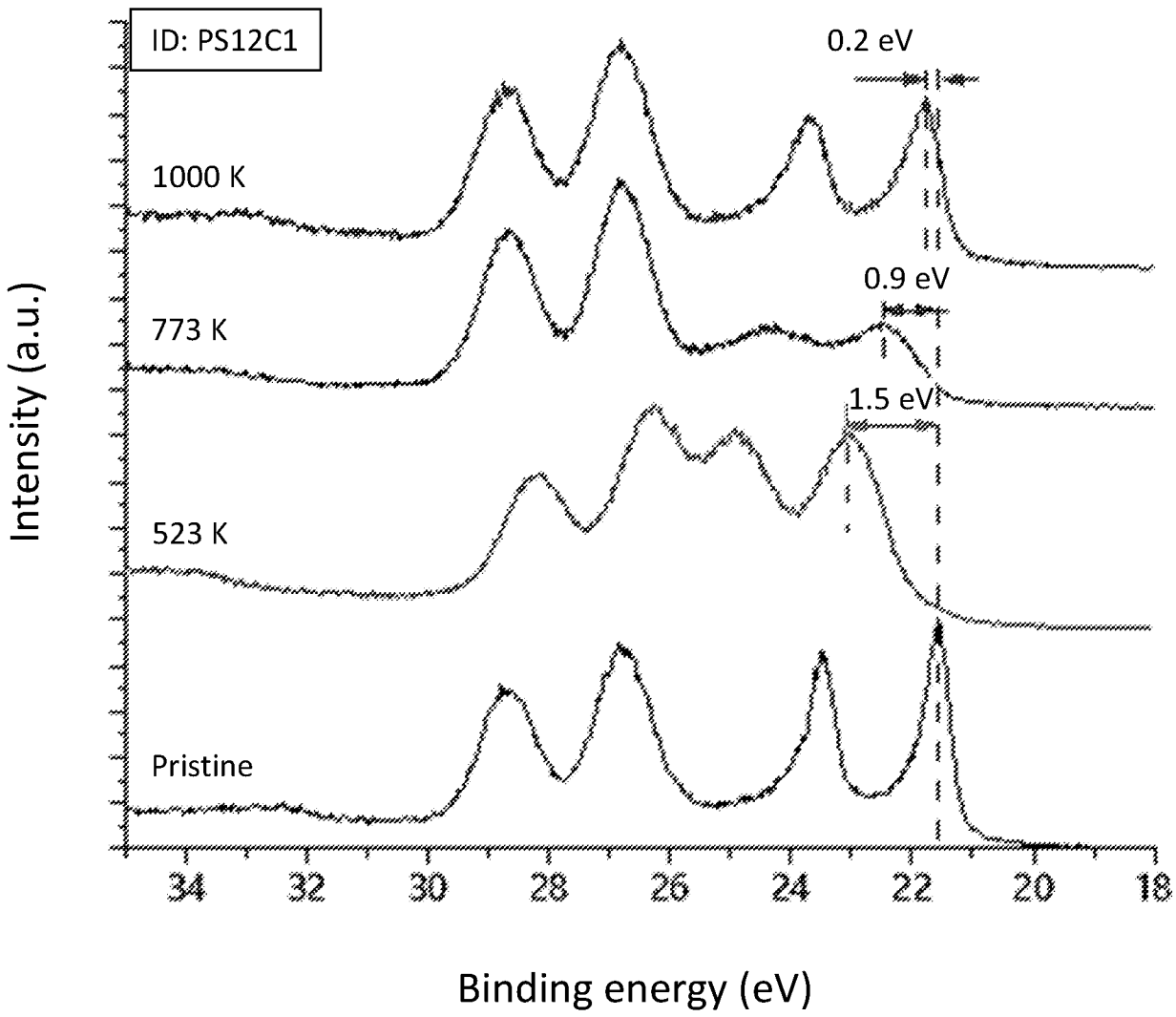
FIG. 7 shows XPS spectra of a cold-sprayed Ta coating before deuterium plasma exposure and after plasma exposure at different temperatures (the coatings were not etched by an ion beam as in FIG. 6).

FIG. 7 shows the XPS spectra of a cold-sprayed Ta coating (spray condition #1) after plasma exposure at different temperatures. The bottom spectrum is for the pristine (non-plasma exposed) coating. The most significant shift in the $Ta^0$ peak occurs at the lowest temperature of 523 K (shift by 1.5 eV) while little shift occurs at the highest temperature of 1000 K (shift by 0.2 eV). These results indicate a greater incorporation of D atoms into the Ta lattice at lower temperature than at high temperatures. In turn, these results mean that the cold-sprayed Ta coatings may be regenerated by outgassing incorporated D at higher temperatures.

Figure 8B:
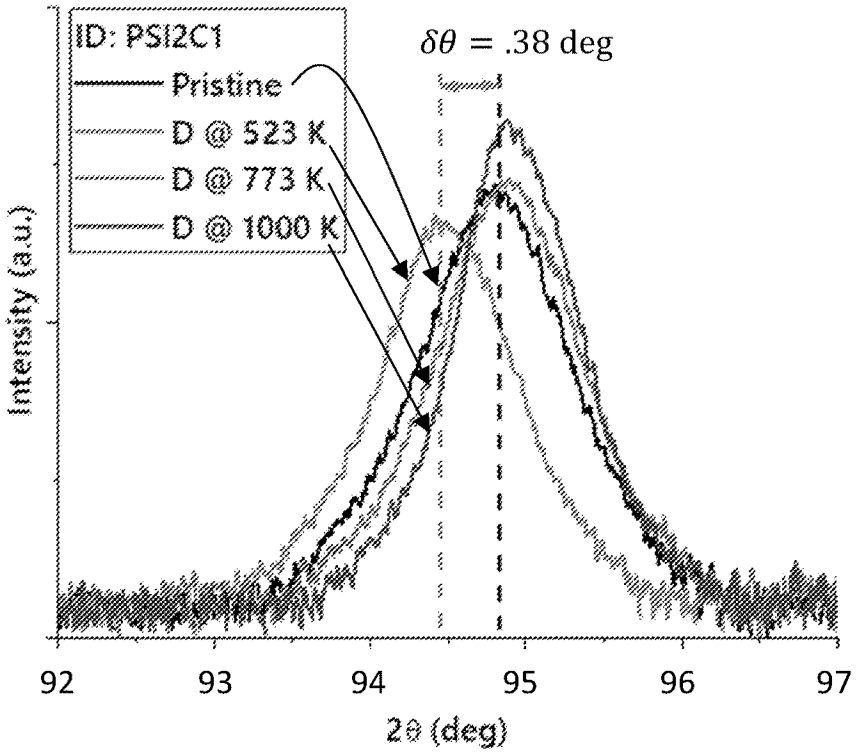
FIG. 8B shows XRD spectra of the samples at atomic plane (310).
Figure 8A:
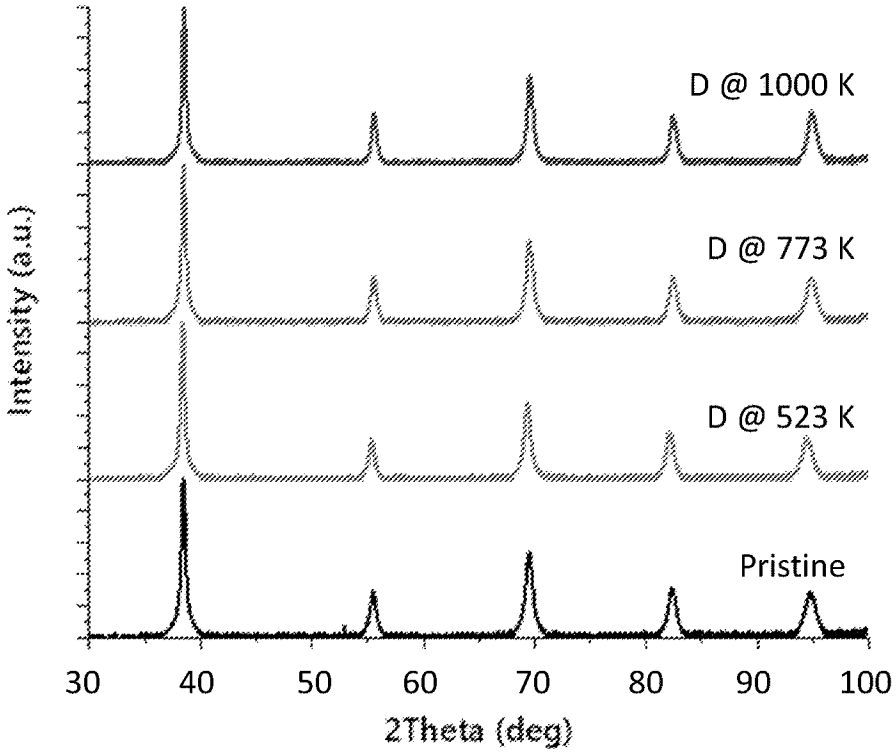
FIG. 8A shows X-ray diffraction (XRD) spectra of a cold-sprayed Ta coating before and after deuterium plasma exposure at different temperatures (the coatings were not etched by an ion beam as in FIG. 6).

The second set of measurements involved X-ray diffraction. Samples were irradiated with X-rays at different angles and the intensities of the diffracted beam were analyzed. For example, FIG. 8A shows the collected X-ray signal from a cold-sprayed Ta coating (spray condition #1) before (bottom), after plasma exposure at different temperatures. The results show that all Ta coatings remain in β phase. FIG. 8B shows XRD spectra of the coatings at atomic plane (310). The results show a peak shift by 0.38 deg towards lower angles in the case of the plasma exposed coating at the lowest temperature of 523 K as compared to the pristine (non-plasma exposed) sample. This shift indicates a change in the atomic plane distances which is attributed to the D incorporation in the lattice. Almost no shift is observed for coatings exposed to the plasma at higher temperatures, suggesting less D incorporation at these higher temperatures.

Although the XPS and XRD techniques do not identify and quantify D directly, the results provide a clear indication of D incorporation in the Ta lattice, and thus, the ability of the cold-sprayed Ta coatings to absorb hydrogen species even under plasma conditions. D incorporation is greatest at 523 K and decreases at 1000 K.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

If not already included, all numeric values of parameters in the present disclosure are proceeded by the term "about" which means approximately. This encompasses those variations inherent to the measurement of the relevant parameter as understood by those of ordinary skill in the art. This also encompasses the exact value of the disclosed numeric value and values that round to the disclosed numeric value.

The foregoing description of illustrative embodiments of the disclosure has been presented for purposes of illustration and of description. It is not intended to be exhaustive or to limit the disclosure to the precise form disclosed, and modifications and variations are possible in light of the above teachings or may be acquired from practice of the disclosure. The embodiments were chosen and described in order to explain the principles of the disclosure and as practical applications of the disclosure to enable one skilled in the art to utilize the disclosure in various embodiments and with various modifications as suited to the particular use contemplated. It is intended that the scope of the disclosure be defined by the claims appended hereto and their equivalents.

What is claimed is:

1. A method comprising:

generating a plasma within an inner volume of a container of a plasma device such that the plasma is surrounded by a gaseous region including a hydrogen species, wherein a coating including cold-sprayed tantalum is disposed on a surface of the inner volume;

heating the plasma to a first temperature of at least about 500 K such that the coating absorbs at least a portion of the hydrogen species;

cooling the plasma to a second temperature less than the first temperature such that the coating retains the absorbed portion of the hydrogen species; and heating the coating to a third temperature, the third temperature greater than the second temperature and less than or equal to about 1000 K such that the coating desorbs at least a portion of the hydrogen species to at least partially regenerate.

2. The method of claim 1, wherein the coating absorbs at least about $10^{19}$ hydrogen species/$cm^2$ after heating to the first temperature and before cooling to the second temperature.

3. The method of claim 1, wherein the hydrogen species includes at least one of a deuterium species or a tritium species.

4. The method of claim 1, wherein the gaseous region has a pressure of $10^{-1}$ mbar or less.

5. The method of claim 1, wherein the hydrogen species comprises hydrogen in its atomic form, hydrogen in its molecular form, an isotope of hydrogen in its atomic form, an isotope of hydrogen in its molecular form, or combinations thereof.

6. The method of claim 1, wherein the coating is in direct contact with the plasma.

7. The method of claim 1, wherein the plasma is characterized by at least one of a temperature of at least 500 K, a pressure of $10^{-1}$ mbar or less, an ion flux of at least $10^{15}$ $D/m^2s$, an ion energy of at least 1 eV, and an incident fluence of at least $10^{20}$ $D/m^2$.

8. The method of claim 1, wherein the surface is stainless steel.

9. The method of claim 8, wherein the surface is one of a stainless steel panel or a plurality of stainless steel panels mounted within the inner volume of the container.

10. The method of claim 9, comprising the plurality of stainless steel panels, wherein some stainless steel panels of the plurality are mounted proximate to walls of the container so as to provide direct contact with the gaseous region surrounding the plasma, but not direct contact with the plasma, and at least one stainless steel panel of the plurality is mounted away from the walls of the container and spaced apart from the stainless steel panels that are proximate to the walls of the container, to provide direct contact with the plasma.

11. The method of claim 1, wherein the coating consists of tantalum.

12. The method of claim 1, wherein the coating is mechanically and metallurgically bound to the surface.

13. The method of claim 1, wherein the coating has an average thickness of at least 150 μm.

14. The method of claim 1, wherein the coating has a hardness of at least 150 $HV_{0.050}$.

15. The method of claim 1, wherein the coating defines a plurality of micro-voids distributed throughout the coating.

16. The method of claim 15, wherein the plurality of micro-voids comprises micro-voids having a largest dimension of at least 3 μm.

17. The method of claim 15, wherein the coating has a porosity of less than 2%.

18. The method of claim 1, wherein the coating defines a fine grain structure with a large area of grain boundaries and other micro-voids.

* * * * *